US010351366B2

(12) United States Patent
Oshida

(10) Patent No.: US 10,351,366 B2
(45) Date of Patent: Jul. 16, 2019

(54) MANUAL TRAY DEVICE AND IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Katsuya Oshida, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/711,059

(22) Filed: Sep. 21, 2017

(65) Prior Publication Data

US 2019/0086853 A1 Mar. 21, 2019

(51) Int. Cl.
*B65H 1/04* (2006.01)
*G03G 15/00* (2006.01)
(Continued)

(52) U.S. Cl.
CPC ..... *B65H 1/04* (2013.01); *B65H 11/02* (2013.01); *G03G 15/6514* (2013.01);
(Continued)

(58) Field of Classification Search
CPC ..... B65H 1/04; B65H 11/02; B65H 2402/31; B65H 2402/32; B65H 2402/441; B65H 2405/321; B65H 2405/324; B65H 2405/354; B65H 2405/1117; B65H 2405/1122; B65H 2511/11; B65H 2405/11; B65H 2405/32; B65H 2407/21; G03G 15/6514; G03G 21/1633
See application file for complete search history.

(56) References Cited

U.S. PATENT DOCUMENTS

2006/0291342 A1* 12/2006 Kang ..... B65H 1/04 369/30.78
2016/0090260 A1* 3/2016 Miura ..... B65H 31/00 271/3.14

(Continued)

FOREIGN PATENT DOCUMENTS

JP 1995-125886 5/1995
JP 2016-000652 1/2016

*Primary Examiner* — David H Bollinger
(74) *Attorney, Agent, or Firm* — Amin, Turocy & Watson LLP

(57) ABSTRACT

A manual tray device comprises a tray storage body; a tray main body rotatably supported on the tray storage body with a lower end side as a rotation fulcrum; an assistance tray arranged at an upstream side of the tray main body in a sheet feed direction; a rotation regulation link, one end part side of the rotation regulation link being rotatably supported on the tray storage body, the other end part side being slidably supported on the tray main body in a predetermined stroke range; and an interlocking mechanism configured to interlock displacement of the other end part side of the rotation regulation link with forward and backward displacement of the assistance tray. The assistance tray protrudes from the tray main body in a state where rotation of the tray main body in the opening direction is regulated by the rotation regulation link.

14 Claims, 7 Drawing Sheets

(51) Int. Cl.
*G03G 21/16* (2006.01)
*B65H 11/02* (2006.01)

(52) U.S. Cl.
CPC ..... *G03G 21/1633* (2013.01); *B65H 2402/32* (2013.01); *B65H 2402/441* (2013.01); *B65H 2405/11* (2013.01); *B65H 2405/1117* (2013.01); *B65H 2405/1122* (2013.01); *B65H 2405/32* (2013.01); *B65H 2405/321* (2013.01); *B65H 2405/324* (2013.01); *B65H 2407/21* (2013.01); *B65H 2511/11* (2013.01)

(56) References Cited

U.S. PATENT DOCUMENTS

| | | | | |
|---|---|---|---|---|
| 2016/0122140 | A1* | 5/2016 | Furusawa | B65H 1/04 271/147 |
| 2017/0050811 | A1* | 2/2017 | Tateishi | B65H 1/04 |
| 2017/0052504 | A1* | 2/2017 | Mori | G03G 15/6514 |

* cited by examiner

MANUAL TRAY DEVICE AND IMAGE FORMING APPARATUS

FIELD

Embodiments described herein relate generally to a manual tray device and an image forming apparatus.

BACKGROUND

An image forming apparatus such as a Multi Function Peripheral (MFP) or a copier, a printer, and the like includes a manual tray device for manually feeding a desired sheet that is different from sheets in a sheet feed cassette for automatically feeding a common sheet. The desired sheet can be, for example, a legal sized sheet or an envelope.

The manual tray device is arranged in a storable manner in an opening for tray storage arranged in a side surface of a housing (tray storage body) of the image forming apparatus. In the manual tray device, a lower end side of a tray main body for placing sheets is rotatably supported in the housing of the image forming apparatus, and is stored in the opening for tray storage when not in use.

Further, there is a case in which a sheet longer than the tray main body is handled in the manual tray device. Thus, a manual tray device provided with an assistance tray for extension is developed. This manual tray device is arranged such that the assistance tray can be pulled out to an upstream side of the tray main body in a sheet feed direction. In a case in which the sheet longer than the tray main body is handled in this manual tray device, the assistance tray is pulled out to a rear side.

However, the manual tray device described above has a complex pull-out operation and return operation of the assistance tray. Further, in the case of the manual tray described above, when the pull-out of the assistance tray is mistakenly unused and the sheet longer than the tray main body is placed on the tray main body, the placement state of the sheet becomes unstable.

Thus, a manual tray device is desired which can automatically carry out a pull-out operation and return operation of the assistance tray depending on an opening and closing operation of the tray main body without the need for the complex pull-out operation and return operation of the assistance tray.

DETAILED DESCRIPTION

Figure 1:
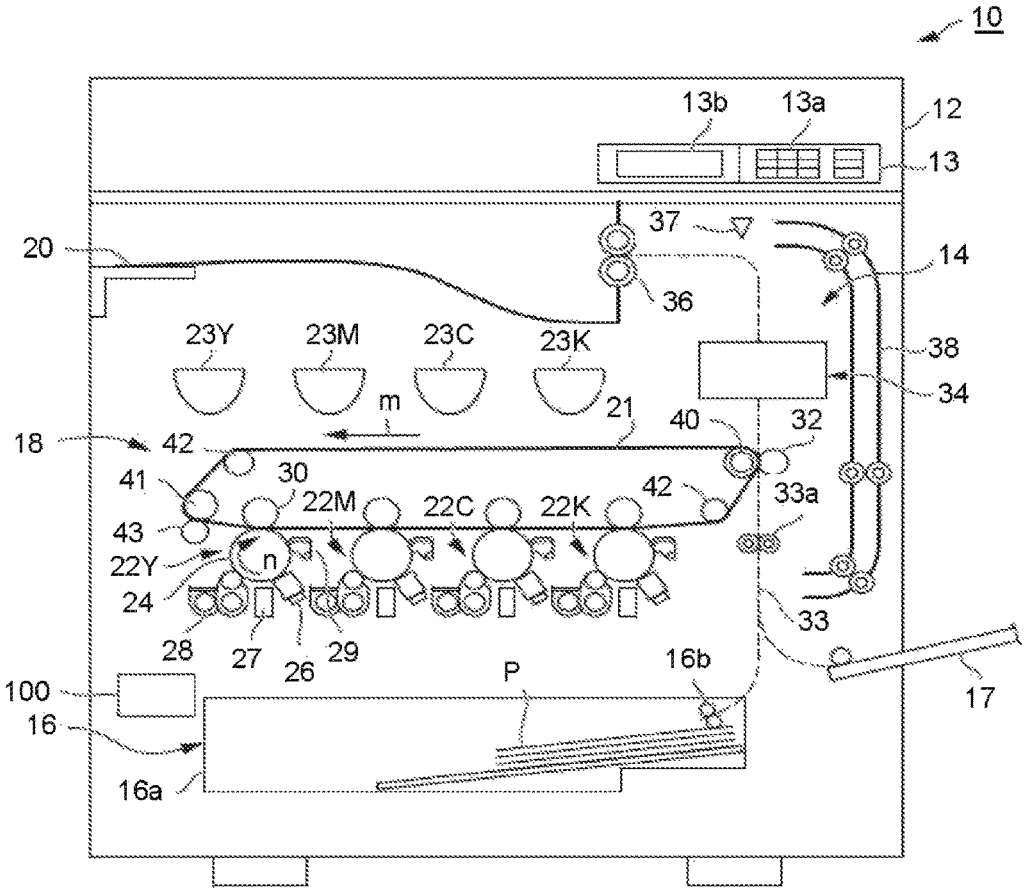
FIG. 1 is a side view of an image forming apparatus including a manual tray device according to an embodiment.

A manual tray device is desired which can avoid the problems described above by automatically carrying out a pull-out operation and return operation of the assistance tray depending on an opening and closing operation of the tray main body without the need for the complex pull-out operation and return operation of the assistance tray.

In accordance with an embodiment, a manual tray device comprises a tray storage body, a tray main body, an assistance tray, a rotation regulation link, and an interlocking mechanism. The tray storage body has an opening for tray storage on a side surface. The tray main body is rotatably supported on the tray storage body between a closing position at which the opening is closed and an opening position at which the tray main body is rotated at a predetermined angle in an opening direction with a lower end side as a rotation fulcrum. The assistance tray is arranged at an upstream side of the tray main body in a sheet feed direction so as to be movable forward or backward. One end part side of the rotation regulation link is rotatably supported on the tray storage body, and the other end part side is slidably supported on the tray main body in a predetermined stroke range. The interlocking mechanism interlocks displacement of the other end part side of the rotation regulation link with forward and backward displacement of the assistance tray. The assistance tray protrudes from the tray main body in a state where rotation of the tray main body in the opening direction is regulated by the rotation regulation link.

Hereinafter, a manual tray device and an image forming apparatus according to an embodiment are descried with reference to the accompanying drawings. Furthermore, the same reference numerals are applied to the same elements in each figure.

FIG. 1 is a side view illustrating an entire constitution of an image forming apparatus 10 according to an embodiment. For example, the image forming apparatus 10 is a Multi Function Peripheral (MFP). However, the image forming apparatus 10 is not limited to the Multi Function Peripheral (MFP) described above and may be a copier and a printer.

The image forming apparatus 10 includes a scanner section 12, a control panel 13, a main body section 14 and a control section 100. The main body section 14 includes a sheet feed cassette section 16, a printer section 18 and a fixing device 34. The control section 100 controls the whole of the image forming apparatus 10. For example, the control section 100 controls operations of the scanner section 12, the control panel 13, the sheet feed cassette section 16, the printer section 18 and the fixing device 34.

The scanner section 12 reads a document image. The control panel 13 includes an input key 13*a* and a display section 13*b*. For example, the input key 13*a* receives an input by a user. For example, the display section 13*b* is a touch panel display section. The display section 13*b* receives an input by the user and carries out display to the user.

The sheet feed cassette section 16 includes a cassette main body 16*a* and a pickup roller 16*b*. The cassette main body 16*a* stores a sheet P serving as an image receiving medium. The pickup roller 16*b* picks up the sheet P from the cassette main body 16*a*. The sheet P picked up from the cassette main body 16*a* is fed to a conveyance path 33.

The printer section 18 forms an image. The printer section 18 forms, for example, a document image read by the scanner section 12. The printer section 18 includes an intermediate transfer belt 21. The printer section 18 supports the intermediate transfer belt 21 by a backup roller 40, a driven roller 41 and a tension roller 42. The backup roller 40 includes a drive section (not shown). The printer section 18 rotates the intermediate transfer belt 21 in an arrow m direction.

The printer section 18 includes four sets of image forming stations 22Y, 22M, 22C and 22K. Each of the image forming stations 22Y, 22M, 22C and 22K is used for image formation of each of Y (yellow), M (magenta), C (cyan) and K (black). The image forming stations 22Y, 22M, 22C and 22K are disposed in parallel at the lower side of the intermediate transfer belt 21 along a rotation direction of the intermediate transfer belt 21.

The printer section 18 includes each of cartridges 23Y, 23M, 23C and 23K above each of the image forming stations 22Y, 22M, 22C and 22K. Each of the cartridges 23Y, 23M, 23C and 23K stores each of Y (yellow) toner, M (magenta) toner, C (cyan) toner and K (black) toner for replenishment.

Hereinafter, the image forming station 22Y of Y (yellow) of the image forming stations 22Y, 22M, 22C and 22K is described as an example. Furthermore, since the image forming stations 22M, 22C and 22K have the same constitution as the image forming station 22Y, the detailed description is omitted.

The image forming station 22Y includes a charging charger 26, an exposure scanning head 27, a developing device 28 and a photoconductor cleaner 29. The charging charger 26, the exposure scanning head 27, the developing device 28 and the photoconductor cleaner 29 are disposed around the photoconductive drum 24 which rotates in an arrow n direction.

The image forming station 22Y includes a primary transfer roller 30. The primary transfer roller 30 faces the photoconductive drum 24 across the intermediate transfer belt 21.

The image forming station 22Y is exposed by the exposure scanning head 27 after the photoconductive drum 24 is charged by the charging charger 26. The image forming station 22Y forms an electrostatic latent image on the photoconductive drum 24. The developing device 28 develops the electrostatic latent image on the photoconductive drum 24 with a two-component developing agent formed by toner and a carrier.

The primary transfer roller 30 primarily transfers toner images formed on the photoconductive drum 24 on the intermediate transfer belt 21. The image forming stations 22Y, 22M, 22C and 22K form color toner images on the intermediate transfer belt 21 by the primary transfer roller 30. The color toner images are formed by sequentially overlapping a Y (yellow) toner image, a M (magenta) toner image, a C (cyan) toner image and a K (black) toner mage. The photoconductor cleaner 29 removes toner left on the photoconductive drum 24 after the primary transfer.

The printer section 18 includes a secondary transfer roller 32. The secondary transfer roller 32 faces the backup roller 40 across the intermediate transfer belt 21. The secondary transfer roller 32 secondarily transfers collectively, on the sheet P, the colorful toner images on the intermediate transfer belt 21. The sheet P is fed from the sheet feed cassette section 16 or the manual tray device 17 along the conveyance path 33. The manual tray device 17 is used when a sheet P other than a sheet P stored in the sheet feed cassette section 16 is temporarily used. The manual tray device 17 is described in detail later.

The printer section 18 includes a belt cleaner 43 facing the driven roller 41 across the intermediate transfer belt 21. The belt cleaner 43 removes toner left on the intermediate transfer belt 21 after the secondary transfer.

A register roller 33*a*, the fixing device 34 and a sheet discharge roller 36 are arranged in the conveyance path 33. A branch section 37 and a reversal conveyance section 38 are arranged at a downstream side of the fixing device 34 of the conveyance path 33. The branch section 37 sends a fixed sheet P to a sheet discharge section 20 or the reversal conveyance section 38. In the case of duplex print, the reversal conveyance section 38 reverses a sheet P sent from the branch section 37 in the direction of the register roller 33*a* to convey the reversed sheet P. The image forming apparatus 10 forms a toner image on the sheet P by the printer section 18 and discharges the sheet P to the sheet discharge section 20.

Furthermore, the image forming apparatus 10 is not limited to a tandem developing system, and the number of the developing devices 28 is not limited either. Also, the image forming apparatus 10 may directly transfer the toner image from the photoconductive drum 24 to the sheet P.

Hereinafter, the manual tray device 17 is described in detail.

First Embodiment

Figure 2:
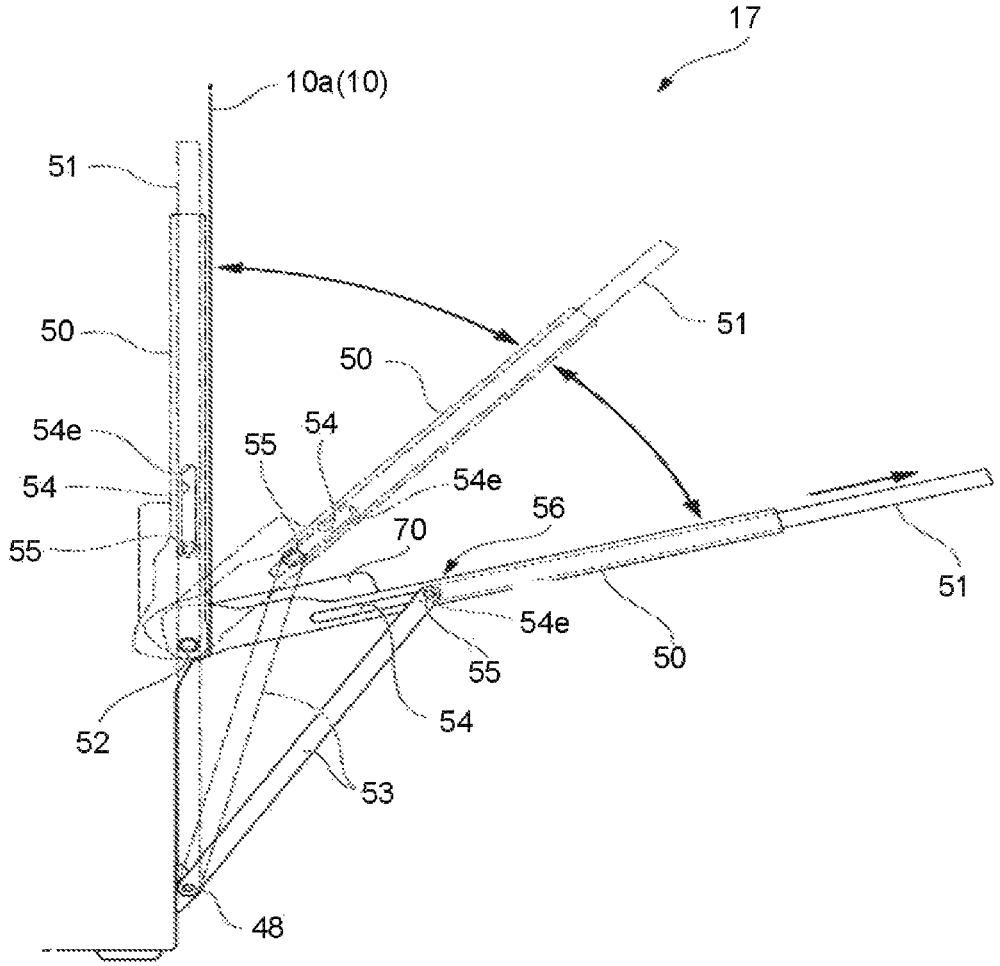
FIG. 2 is a side view of a manual tray device according to a first embodiment.
Figure 3:
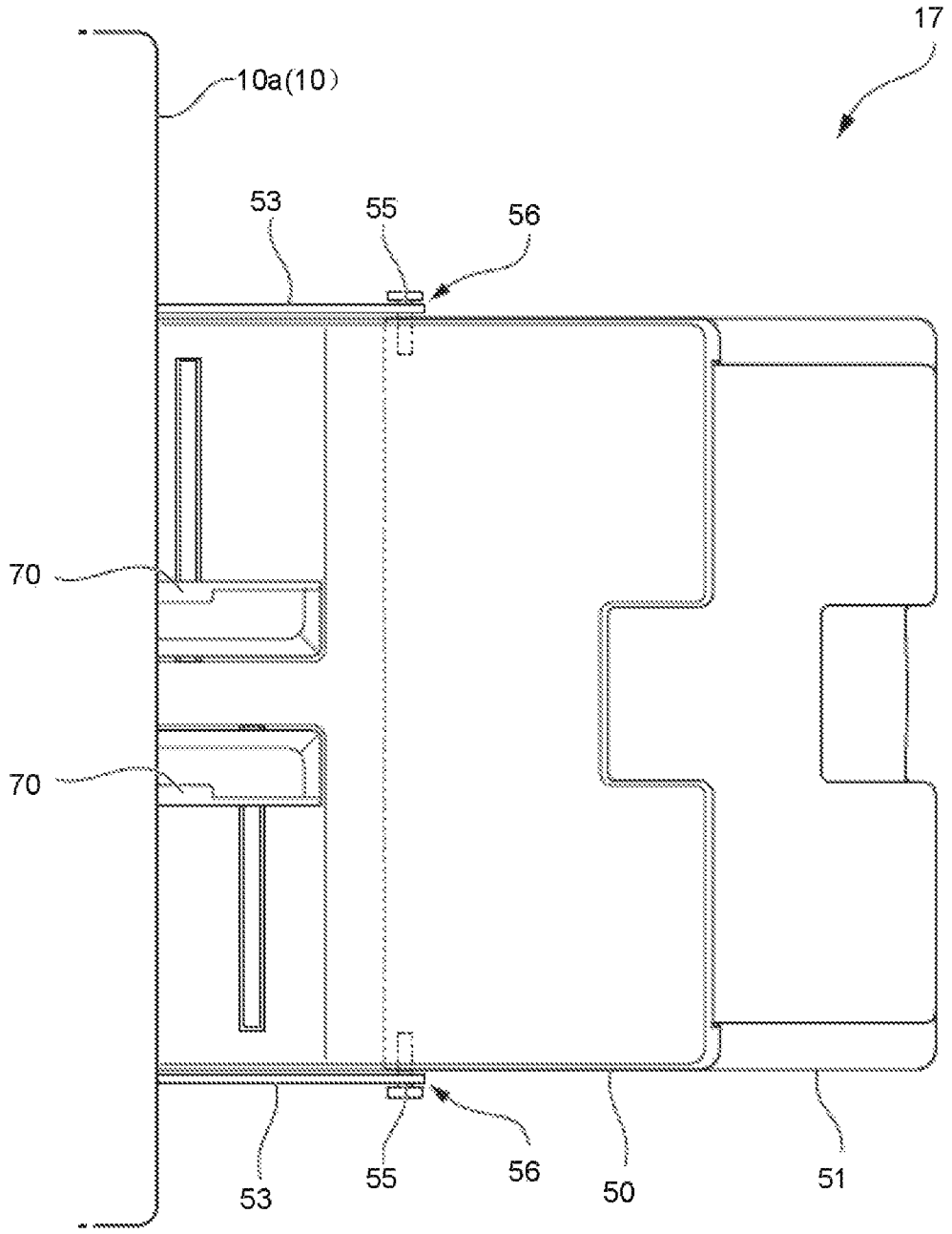
FIG. 3 is a plan view of the manual tray device according to the first embodiment.

FIG. 2 is a side view of the manual tray device 17 according to the first embodiment. FIG. 3 is a plan view of the manual tray device 17 according to the first embodiment.

An opening for tray storage (not shown) is arranged in a housing 10*a* of the image forming apparatus 10 which serves as the tray storage body. The opening for tray storage is formed on a side surface (side surface at right sides in FIG. 1 and FIG. 2) of the housing 10*a*. The tray device 17 includes a tray main body 50 and an assistance tray 51.

The tray main body 50 serves as a cover body for blocking the opening for tray storage of the housing 10*a*. The tray main body 50 has a rotation fulcrum 52 at a lower side end, and is supported rotatably on a side surface of the housing 10*a* with the rotation fulcrum 52 as the center. The tray main body 50 is opened to an outer side of the housing 10*a* at a predetermined angle (is inclined upwards at a predetermined angle) with the rotation fulcrum 52 as the center, and a sheet is placed on the upper surface side in this state. A conveyance mechanism (not shown) for conveying a sheet placed on the tray main body 50 is disposed inside the housing 10*a*.

Herein, a side of the tray main body 50 rotatably supported on the housing 10*a* is referred to as a "base part side", and an opposite side to the "base part side" is referred to as a "top end part side".

A pair of guide pieces 70 for guiding two sides of a sheet placed on the tray main body 50 in a width direction is arranged at the upper surface of the base part side of the tray main body 50. The guide pieces 70 are held on the tray main body 50 in the width direction so as to be capable of adjusting positions thereof. It is possible that the pair of guide pieces 70 is interlocked such that positions of both of the guide pieces 70 are changed by the same amount in opposite directions. In this way, if one guide piece 70 is operated in the width direction, the position of the other guide piece 70 is changed by the same amount in the opposite direction. In this way, by adjusting the positions of the pair of guide pieces 70 in the width direction, a guide width of the sheet placed on the tray main body 50 can be changed depending on the size of the sheet.

The assistance tray 51 is stored so as to be capable of being pulled out from the top end part side of the tray main body 50 by a predetermined amount. In a state where the tray main body 50 closes the opening of the housing 10*a*, a main portion of the assistance tray 51 is stored in the inner part of the tray main body 50. The assistance tray 51 protrudes to the top end part side (upstream side in the sheet feed direction) of the tray main body 50 in a state of rotating in the opening direction at a predetermined angle. The assistance tray 51 extends a substantial sheet placing length of the tray main body 50 by protruding from the top end part side of the tray main body 50. The assistance tray 51 is slidably held in the tray main body 50, The manual tray device 17 includes a rotation regulation link 53. A lower end part side (one end part side) of the rotation regulation link 53 is rotatably supported on the housing 10*a* by a support shaft 48. The support shaft 48 is disposed at a position at a lower side of the housing 10*a* with respect to the rotation fulcrum 52 of the tray main body 50. The upper end part side (the other end part side) of the rotation regulation link 53 is rotatably supported in a guide groove 54 arranged in the tray main body 50. The guide groove 54 is formed in a side wall standing from a side part of the tray main body 50. The guide groove 54 is a long hole-shaped groove passing through the side wall of the tray main body 50, and is formed substantially along the sheet feed direction of the tray main body 50. A support shaft 55 is arranged in an upper end part (the other end part) of the rotation regulation link 53. The support shaft 55 is slidably inserted into the guide groove 54. In the case of the present embodiment, the side wall of the tray main body 50 having the guide groove 54 and the rotation regulation link 53 are similarly arranged on two side parts of the tray main body 50.

However, installation numbers and disposition of the guide grooves 54 and the rotation regulation links 53 are optional, and are not limited to the example described herein.

Further, the support shaft 55 at the upper end part side of the rotation regulation link 53 can slide in a range in an extending direction of the guide groove 54. The upper end part side of the rotation regulation link 53 is slidably supported in the tray main body 50 in a predetermined stroke range in which the support shaft 55 can move within the guide groove 54. A rotation angle of the tray main body 50 in the opening direction with respect to the housing 10*a* is regulated in such a manner that the support shaft 55 abuts against one end part 54*e* (end part at the upstream side in the sheet feed direction) of the guide groove 54.

The support shaft 55 at the upper end part side (the other end part side) of the rotation regulation link 53 is rotatably coupled with a base end part (end part at a front side in the sheet feed direction) of the assistance tray 51. Thus, if the support shaft 55 is guided to the guide groove 54 and displaced with respect to the tray main body 50, the assistance tray 51 is displaced forward or backward with respect to the tray main body 50 depending on this displacement. In the case of the present embodiment, a slide guide section composed of the support shaft 55 and the guide groove 54 and a rotatable coupling section of the support shaft 55 and the assistance tray 51 constitute an interlocking mechanism 56.

The interlocking mechanism 56 interlocks the displacement of the upper end part side (the other end part side) of the rotation regulation link 53 with the forward and backward displacement of the assistance tray 51. When the tray main body 50 stands and the support shaft 55 is located at the other end part side of the guide groove 54, the interlocking mechanism 56 retreats the assistance tray 51 to the maximum extent and stores the assistance tray 51 inside the tray main body 50. Further, if the tray main body 50 is rotated in the opening direction and the support shaft 55 is slid and displaced to one end part 54*e* of the guide groove 54, the interlocking mechanism 56 protrudes the assistance tray 51 from the tray main body 50 to a rear side. The assistance tray 51 protrudes from the tray main body 50 to the rear side to the maximum extent in a state where the rotation of the tray main body 50 in the opening direction is regulated by the rotation regulation link 53.

Further, an opening and closing operation knob (not shown) for opening and closing the tray main body 50 is arranged at a suitable position on an outer side surface of the tray main body 50 serving as a cover body.

The manual tray device 17 according to the present embodiment includes the rotation regulation link 53 for regulating the rotation of the tray main body 50 in the opening direction, and the interlocking mechanism 56 for interlocking the displacement of the other end part side of the rotation regulation link 53 with the forward and backward displacement of the assistance tray 51. Then, one end part side of the rotation regulation link 53 is rotatably supported on the housing 10*a*, and the other end part side is slidably supported on the tray main body 50 in a predetermined stroke range. Further, the assistance tray 51 is configured to protrude from the tray main body 50 in a state where the rotation of the tray main body 50 in the opening direction is regulated by the rotation regulation link 53.

The manual tray device 17 according to the present embodiment opens the tray main body 50 such that the assistance tray 51 protrudes to the rear side by a predetermined amount, interlocking with the opening operation. Thus, a length of a placeable sheet is expanded automatically without carrying out an operation for manually pulling out the assistance tray 51 after the tray main body 50 is opened. Therefore, in a case in which the manual tray device 17 according to the present embodiment is adopted, the complex pull-out operation of the assistance tray 51 becomes unnecessary, and it is possible that the pull-out of the assistance tray 51 is not forgot.

Further, the manual tray device 17 according to the present embodiment closes the tray main body 50 such that the assistance tray 51 is stored in the tray main body 50 interlocking with the closing operation. Thus, it is possible to automatically store the assistance tray 51 and close the tray main body without carrying out the storage operation of the assistance tray 51 separately from the closing operation of the tray main body 50.

Further, in the manual tray device 17 according to the present embodiment, the lower end part side of the rotation regulation link 53 is rotatably supported on the housing 10*a* at a position at a lower side with respect to the rotation fulcrum 52 of the tray main body 50, and the support shaft 55 at the upper end part side of the rotation regulation link 53 is slidably inserted into the guide groove 54 of the tray main body 50. Then, the rotation of the tray main body 50 in the opening direction is regulated in such a manner that the support shaft 55 abuts against the end part of the guide groove 54 at the upstream side in the sheet feed direction. Thus, in a case in which this constitution is adopted, the constitution is simple, while the opening of the tray main body 50 is regulated at a predetermined angle, and slide displacement along the tray main body 50 at the upper end part side of the rotation regulation link 53 can be achieved.

Further, in the manual tray device 17 according to the present embodiment, the interlocking mechanism 56 is constituted in such a manner that the support shaft 55 at the upper end part side of the tray main body 50 is rotatably coupled with the assistance tray 51. Thus, the manual tray device 17 according to the present embodiment has the simple constitution, while the opening and closing operation of the tray main body 50 and the protrusion and retreat operation of the assistance tray 51 can be interlocked.

Second Embodiment

Figure 4:
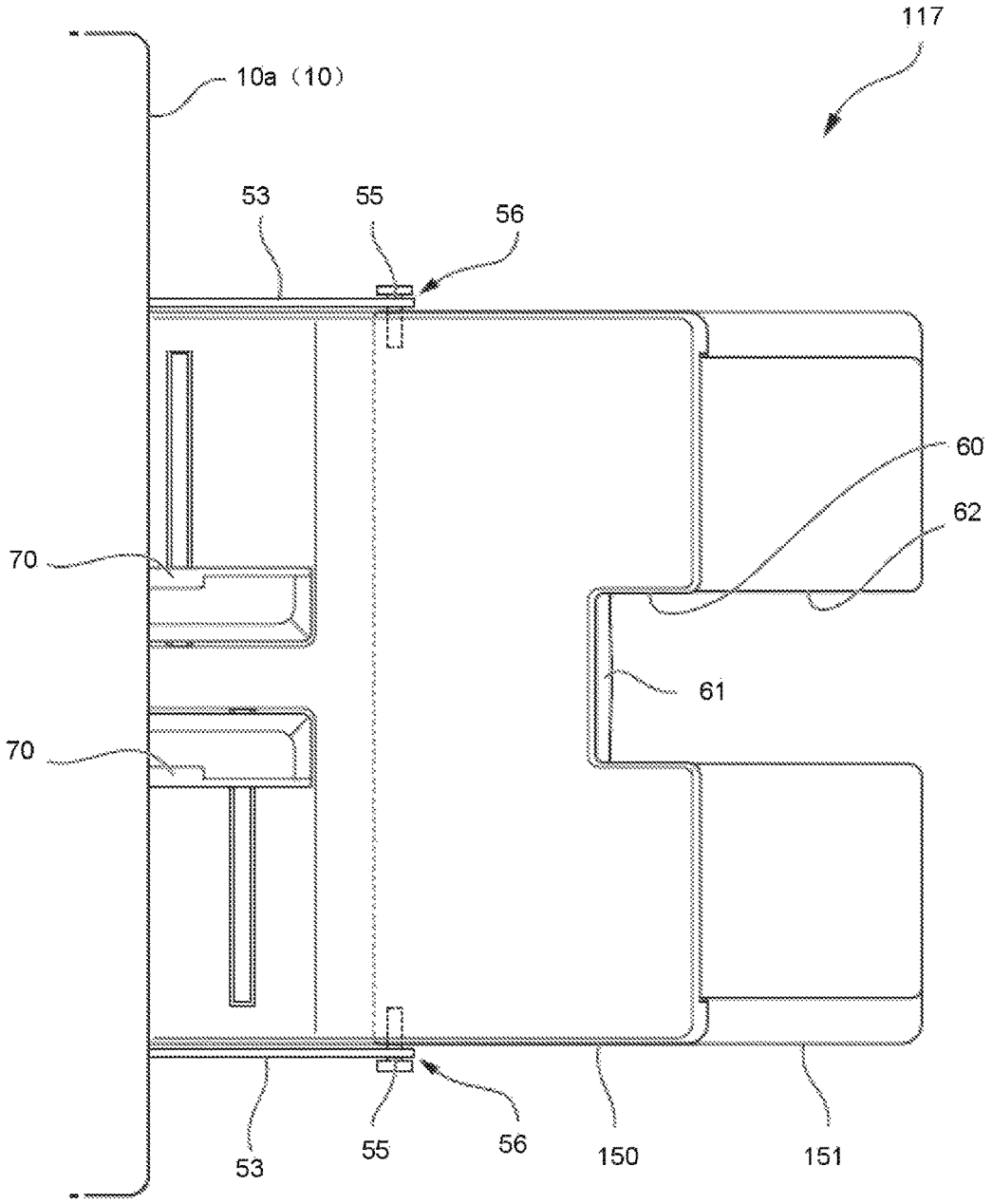
FIG. 4 is a plan view of a manual tray device according to a second embodiment.

FIG. 4 is a plan view of a manual tray device 117 according to the second embodiment.

The manual tray device 117 of the second embodiment has substantially the same basic constitution as the first embodiment. A recess 60 opened to the upstream side in an almost U shape is arranged in a central area in the width direction of the tray main body 150 at the upstream side in the sheet feed direction. An opening and closing operation knob 61 protruding to an outer surface side of the tray main body 150 is formed on a bottom side of the recess 60. The opening and closing operation knob 61 is gripped by an operator at the time of the opening and closing operation of the tray main body 150. A finger hooking part of the opening and closing operation knob 61 extends along the width direction of the tray main body 150.

An assistance tray 151 is arranged with a recess 62 in an almost U shape deeper than the recess 60 of the tray main body 150 in a central area in the width direction at the upstream side in the sheet feed direction. The bottom edge of the recess 62 is set so as not to protrude from the recess 60 of the tray main body 150 even when the assistance tray 151 protrudes from the tray main body 150 to the rear side.

Thus, in the case of the manual tray device 117 according to the present embodiment, when the operator grips the opening and closing operation knob 61 of the tray main body 150 to carry out the opening and closing operation of the tray main body 150, the assistance tray 151 can avoid interfering fingers and arms of the operator.

Third Embodiment

Figure 5:
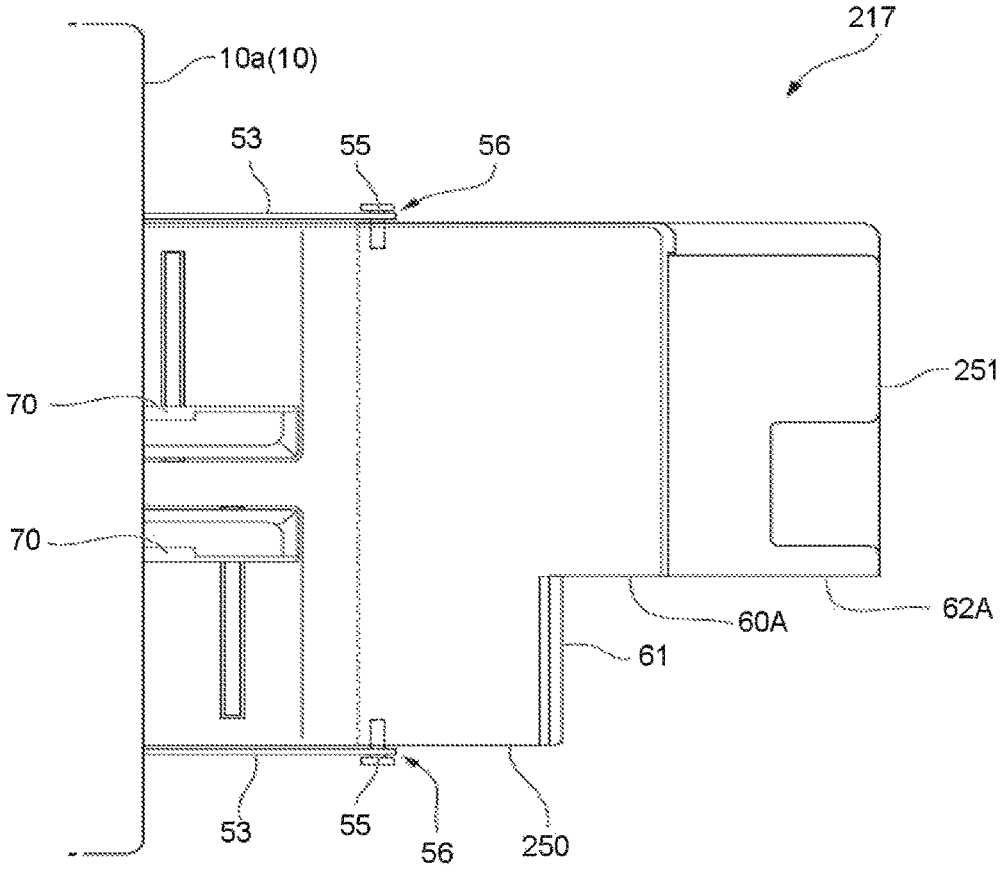
FIG. 5 is a plan view of a manual tray device according to a third embodiment.

FIG. 5 is a plan view of a manual tray device 217 according to the third embodiment.

The manual tray device 217 according to the third embodiment has substantially the same basic constitution as the first embodiment. A recess 60A opened to a rear side and one end side (side at which the operator stands to carry out an operation) in the width direction is arranged on a rear part of a tray main body 250. The opening and closing operation knob 61 protruding to an outer side of the tray main body 250 is formed on an edge of the recess 60A at the front side in the sheet feed direction. A finger hooking part of the opening and closing operation knob 61 extends along the width direction of the tray main body 250.

A recess 62A opened to a rear side and one end side in the width direction is arranged on a rear part of an assistance tray 251. The depth of the recess 62A in the front and rear direction is set to be greater than that of the recess 60A of the tray main body 250. The bottom edge of the recess 62A is set so as not to protrude from the recess 60A of the tray main body 250 even when the assistance tray 251 protrudes from the tray main body 250 to the rear side.

Even in the case of the manual tray device 217 according to the present embodiment, when the operator grips the opening and closing operation knob 61 of the tray main body 250 to carry out the opening and closing operation of the tray main body 250, the assistance tray 251 can avoid interfering fingers and arms of the operator.

Fourth Embodiment

Figure 6:
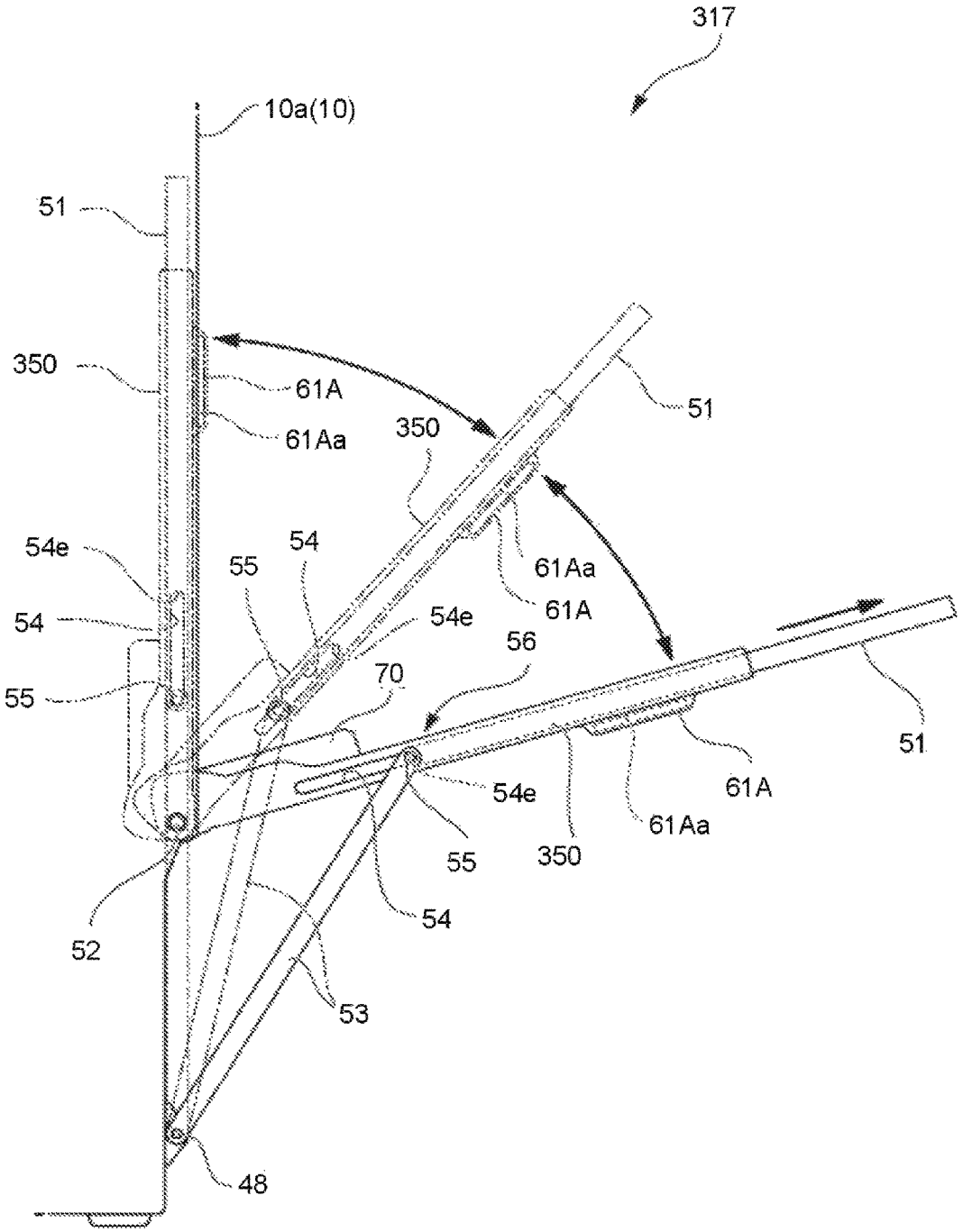
FIG. 6 is a side view of a manual tray device according to a fourth embodiment.

FIG. 6 is a side view of a manual tray device 317 according to the fourth embodiment.

The manual tray device 317 according to the fourth embodiment has substantially the same basic constitution as the first embodiment. In the manual tray device 317 according to the present embodiment, an opening and closing operation knob 61A of which a finger hooking part 61Aa extends along the sheet feed direction is arranged on the outer side surface of a tray main body 350.

In the manual tray device 317 according to the present embodiment, since the finger hooking part 61Aa of the opening and closing operation knob 61A extends along the sheet feed direction, at the time of the opening and closing operation of the tray main body 250, the assistance tray 51 does not interfere fingers and arms of the operator who grips the opening and closing operation knob 61A.

Fifth Embodiment

Figure 7:
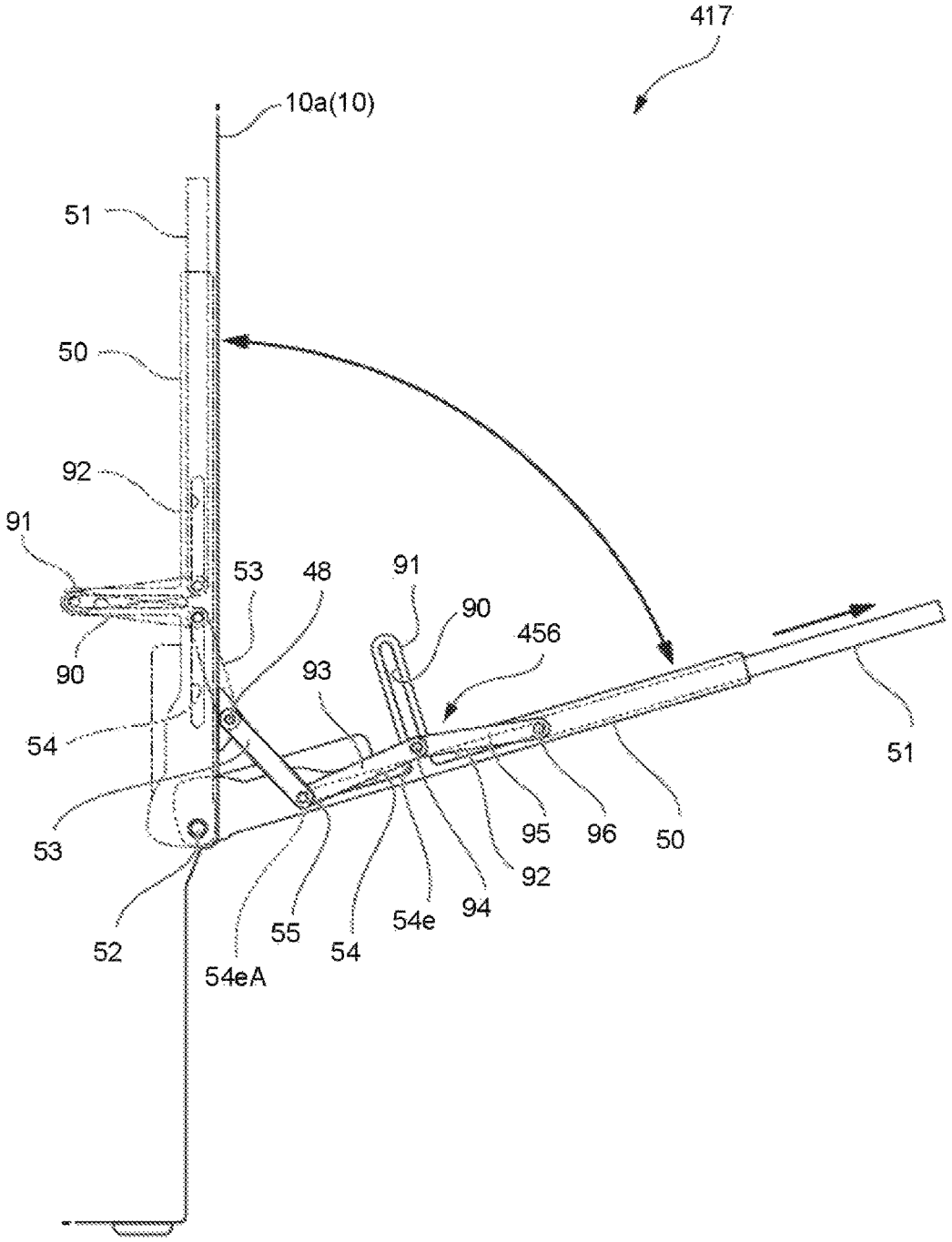
FIG. 7 is a side view of a manual tray device according to a fifth embodiment.

FIG. 7 is a side view of a manual tray device 417 according to the fifth embodiment.

The manual tray device 417 according to the fifth embodiment includes the housing 10*a* serving as the tray storage body, the tray main body 50, the assistance tray 51, the rotation regulation link 53, and an interlocking mechanism 456, similar to the manual tray device 17 according to the first embodiment. However, the manual tray device 417 according to the fifth embodiment is different from the manual tray device 17 according to the first embodiment in that one end part side (the support shaft 48) of the rotation regulation link 53 is rotatably supported on the housing 10*a* at a position at an upper side with respect to the rotation fulcrum 52 of the tray main body 50, and in the concrete constitution of the interlocking mechanism 456.

The support shaft 48 of the rotation regulation link 53 is arranged at one end part side. The support shaft 48 is supported on the housing 10*a* at a position at an upper side with respect to the rotation fulcrum 52 of the tray main body 50. The support shaft 55 is arranged at the other end part side of the rotation regulation link 53. The support shaft 55 is slidably inserted into the guide groove 54 (hereinafter, referred to as a "first guide groove 54") of the tray main body 50. The first guide groove 54 is formed in the side wall of the tray main body 50 substantially along the sheet feed direction, similar to the first embodiment.

The support shaft 55 is located on one end part 54*e* (end part at the upstream side in the sheet feed direction) side of the first guide groove 54 when the tray main body 50 is in a standing state. Further, if the tray main body 50 is rotated in the opening direction from the standing state, the support shaft 55 is slid and displaced to the other end part 54*e*A (end part at a front side in the sheet feed direction) side of the first guide groove 54. Then, if the tray main body 50 is rotated to a predetermined angle, the support shaft 55 abuts against the other end part 54*e*A of the first guide groove 54. In this way, further rotation of the tray main body 50 is regulated.

Further, a guide piece 91 is extended on the side wall of the tray main body 50. The guide piece 91 is disposed at a position adjacent to the upstream side of the first guide groove 54 in the sheet feed direction. A second guide groove 90 extending substantially along a direction orthogonal to the sheet feed direction of the tray main body 50 is formed in the guide piece 91. For the second guide groove 90, an end part at a side approaching the outer side surface of the tray main body 50 is referred to as a "lower end part", and an end part at an opposite side to the "lower end part" is referred to as an "upper end part".

A third guide groove 92 is further arranged in the side wall of the tray main body 50. The third guide groove 92 is disposed adjacent to the upstream side of the lower end part of the second guide groove 90 in the sheet feed direction. The third guide groove 92 extends substantially along the sheet feed direction of the tray main body 50, similar to the first guide groove 54. For the third guide groove 92, an end part at a side approaching the second guide groove 90 is referred to as a "one end part", and an end part at an opposite side to the "one end part" is referred to as an "the other end part".

One end part of a first link 93 is rotatably coupled with the support shaft 55 of the rotation regulation link 53. A first shaft 94 is arranged on the other end part of the first link 93. The first shaft 94 is slidably inserted into the second guide groove 90 of the guide piece 91. Further, one end part of a second link 95 is rotatably coupled with the first shaft 94. A second shaft 96 is arranged on the other end part of the second link 95. The second shaft 96 is slidably inserted into the third guide groove 92. Further, the second shaft 96 is rotatably coupled with the assistance tray 51. Thus, if the second shaft 96 moves to the other end part side (upstream side in the sheet feed direction) within the third guide groove 92, the assistance tray 51 protrudes to the rear side together with the movement.

In according to the present embodiment, the first guide groove 54, the support shaft 55, the first link 93, the first shaft 94, the second guide groove 90, the second link 95, the second shaft 96, and the third guide groove 92 constitute the interlocking mechanism 456.

Hereinafter, operations of the interlocking mechanism 456 are described.

When the tray main body 50 is in the standing state, as shown by an imaginary line in FIG. 7, the support shaft 55 of the rotation regulation link 53 is located on one end part 54*e* side of the first guide groove 54, and the first shaft 94 of the first link 93 is located on the upper end part side of the second guide groove 90. Further, at this time, the second shaft 96 of the second link 95 is located on one end part (end part at the front side in the sheet feed direction) side of the third guide groove 92.

If the tray main body 50 is rotatably operated in the opening direction from this state, the support shaft 55 of the rotation regulation link 53 moves within the first guide groove 54 in the direction of the other end part 54*e*A, and the first shaft 94 of the first link 93 moves within the second guide groove 90 in the direction of the lower end part together with the movement. At this time, the second shaft 96 of the second link 95 moves to the other end part (end part at the upstream side in the sheet feed direction) side within the third guide groove 92. Further, the assistance tray 51 protrudes to the upstream side in the sheet feed direction.

In this way, if the support shaft 55 of the rotation regulation link 53 abuts against the other end part 54*e*A of the first guide groove 54, the rotation of the tray main body 50 is regulated in a state where the tray main body 50 is opened at a predetermined angle. Further, the assistance tray 51 protrudes from the tray main body 50 to the rear side to the maximum extent.

Further, if the tray main body 50 is rotatably operated in the closing direction from this state, each section of the interlocking mechanism 456 operates in the opposite direction to the above direction and is returned to the original state.

In the manual tray device 417 according to the present embodiment, through the function of the interlocking mechanism 456, the assistance tray 51 operates forward or backward depending on the opening and closing operation of the tray main body 50. Thus, it is possible to automatically carry out the pull-out operation and return operation of the assistance tray 51 depending on the opening and closing operation of the tray main body 50 without the need for the complex pull-out operation and return operation of the assistance tray 51.

Furthermore, the interlocking mechanism 456 is not limited to the interlocking mechanism described herein, and may be another structure as long as the mechanism can interlock and displace the support shaft 55 of the rotation regulation link 53 and the assistance tray 51 in opposite directions along the extending direction of the first guide groove 54.

Further, in the manual tray device 417 according to the present embodiment, one end part side of the rotation regulation link 53 is rotatably supported on the housing 10*a* at a position at an upper side with respect to the rotation fulcrum 52 of the tray main body 50. Thus, the rotation regulation link 53 can be stored inside the opening for tray storage of the housing 10*a*. Thus, in a case in which this constitution is adopted, the rotation regulation link 53 is not exposed to the outer side of the housing 10*a* in a state where the tray main body 50 is closed, and good appearance is achieved.

According to at least one embodiment described above, it is possible to automatically carry out a pull-out operation and return operation of an assistance tray depending on an opening and closing operation of a tray main body without the need for a complex pull-out operation and return operation of the assistance tray.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A manual tray device, comprising:

a tray storage body having an opening for tray storage on a side surface;

a tray main body rotatably supported on the tray storage body between a closed position at which the opening is closed and an open position at which the tray main body is rotated at a predetermined angle in an opening direction with a lower end side as a rotation fulcrum;

an assistance tray arranged at an upstream side of the tray main body in a sheet feed direction so as to be movable forward or backward;

a rotation regulation link, one end part side of the rotation regulation link being rotatably supported on the tray storage body, the other end part side being slidably supported on the tray main body in a predetermined stroke range; and an interlocking mechanism configured to interlock displacement of the other end part side of the rotation regulation link with forward and backward displacement of the assistance tray, wherein the assistance tray protrudes from the tray main body in a state where rotation of the tray main body in the opening direction is regulated by the rotation regulation link.

2. The manual tray device according to claim 1, further comprising a support shaft that is held on the other end part side of the rotation regulation link;

a guide groove extending substantially along the sheet feed direction that is arranged in the tray main body;

wherein the support shaft is slidably inserted into the guide groove; and rotation and displacement of the tray main body in the opening direction is regulated in such a manner that the support shaft abuts against an end part of the guide groove in an extending direction.

3. The manual tray device according to claim 2, wherein one end part side of the rotation regulation link is rotatably supported on the tray storage body at a position at a lower side with respect to the rotation fulcrum of the tray main body; and the rotation of the tray main body in the opening direction is regulated in such a manner that the other end part side of the rotation regulation link abuts against an end part of the guide groove at an upstream side in the sheet feed direction.

4. The manual tray device according to claim 3, wherein the interlocking mechanism comprises coupling the support shaft with the assistance tray.

5. The manual tray device according to claim 2, wherein one end part side of the rotation regulation link is rotatably supported on the tray storage body at a position at an upper side with respect to the rotation fulcrum of the tray main body; and the rotation of the tray main body in the opening direction is regulated in such a manner that the other end part side of the rotation regulation link abuts against an end part of the guide groove at a front side in the sheet feed direction.

6. The manual tray device according to claim 5, wherein the interlocking mechanism is configured to interlock and displace the support shaft and the assistance tray in opposite directions along the extending direction of the guide groove.

7. An image forming apparatus, comprising:

a printer section configured to print data;

a manual tray device configured to place a sheet conveyed to the printer section, wherein the manual tray device comprises:

a tray storage body having an opening for tray storage on a side surface;

a tray main body rotatably supported on the tray storage body between a closed position at which the opening is closed and an open position at which the tray main body is rotated at a predetermined angle in an opening direction with a lower end side as a rotation fulcrum;

an assistance tray arranged at an upstream side of the tray main body in a sheet feed direction so as to be movable forward or backward;

a rotation regulation link, one end part side of the rotation regulation link being rotatably supported on the tray storage body, the other end part side being slidably supported on the tray main body in a predetermined stroke range; and an interlocking mechanism configured to interlock displacement of the other end part side of the rotation regulation link with forward and backward displacement of the assistance tray, wherein the assistance tray protrudes from the tray main body in a state where rotation of the tray main body in the opening direction is regulated by the rotation regulation link.

8. The image forming apparatus according to claim 7, further comprising:

a support shaft that is held on the other end part side of the rotation regulation link;

a guide groove extending substantially along the sheet feed direction that is arranged in the tray main body; wherein the support shaft is slidably inserted into the guide groove; and rotation and displacement of the tray main body in the opening direction is regulated in such a manner that the support shaft abuts against an end part of the guide groove in an extending direction.

9. The image forming apparatus according to claim 8, wherein one end part side of the rotation regulation link is rotatably supported on the tray storage body at a position at a lower side with respect to the rotation fulcrum of the tray main body; and the rotation of the tray main body in the opening direction is regulated in such a manner that the other end part side of the rotation regulation link abuts against an end part of the guide groove at an upstream side in the sheet feed direction.

10. The image forming apparatus according to claim 9, wherein the interlocking mechanism comprises coupling the support shaft with the assistance tray.

11. The image forming apparatus according to claim 8, wherein one end part side of the rotation regulation link is rotatably supported on the tray storage body at a position at an upper side with respect to the rotation fulcrum of the tray main body; and the rotation of the tray main body in the opening direction is regulated in such a manner that the other end part side of the rotation regulation link abuts against an end part of the guide groove at a front side in the sheet feed direction.

12. The image forming apparatus according to claim 11, wherein the interlocking mechanism is configured to interlock and displace the support shaft and the assistance tray in opposite directions along the extending direction of the guide groove.

13. The image forming apparatus according to claim 7, wherein the image forming apparatus is a Multi Function Peripheral.

14. The image forming apparatus according to claim 7, wherein the image forming apparatus is a copier.

* * * * *